US005974740A

United States Patent [19]

Park

[11] Patent Number: 5,974,740

[45] Date of Patent: Nov. 2, 1999

[54] ADJUSTABLE TARPAULIN

[76] Inventor: Peter C. Park, 13615 Larwin Cir., Santa Fe Springs, Calif. 90670

[21] Appl. No.: 08/798,281

[22] Filed: Feb. 14, 1997

[51] Int. Cl.[6] ..... E04B 2/30

[52] U.S. Cl. ..... 52/3; 52/4; 135/115; 135/119

[58] Field of Search ..... 52/3, 4; 135/115, 135/119, 120.2, 120.3, 120.4, 900, 902, 907

[56] References Cited

U.S. PATENT DOCUMENTS

| | | | |
|---|---|---|---|
| 778,620 | 12/1904 | Wylie et al. . | |
| 1,600,749 | 9/1926 | Barnes . | |
| 1,833,095 | 11/1931 | Smith | 135/119 X |
| 1,954,554 | 4/1934 | Angier . | |
| 2,196,704 | 4/1940 | Markle | 135/115 X |
| 2,455,237 | 11/1948 | Davis . | |
| 3,063,062 | 11/1962 | Logan | 135/115 X |
| 3,598,133 | 8/1971 | Abert | 135/115 X |
| 3,987,592 | 10/1976 | Herminghaus et al. . | |
| 4,094,021 | 6/1978 | Rapp . | |
| 4,413,029 | 11/1983 | Handwerker . | |
| 5,363,605 | 11/1994 | Handwerker . | |

FOREIGN PATENT DOCUMENTS

| | | | |
|---|---|---|---|
| 249252 | 7/1912 | Germany | 135/119 |

*Primary Examiner*—Christopher Kent
*Assistant Examiner*—Timothy B. Kang
*Attorney, Agent, or Firm*—John K. Park; Law Offices of John K. Park & Associates

[57] ABSTRACT

An adjustable tarpaulin (11) that can be adjusted to various predetermined lengths, and more securely fastened. The adjustability of the adjustable tarpaulin (11) is provided by having one or more sets of valances of the top layer (23, 41) and the valances of the bottom layer (27, 43). Because the valances are free on one end, the length of each of the valance side edges may be adjusted as desired and the valances provide two different pull angles to share the load of the tarpaulin. By doing so, the adjustable tarpaulin (11) enables the tarpaulin to be adjusted between two or more prefixed sizes. Moreover the adjustable tarpaulin (11) can provide the distribution of the load from more than one angle so stress and the load will be distributed over two different sets of tie points (33).

3 Claims, 5 Drawing Sheets

ADJUSTABLE TARPAULIN

BACKGROUND

This invention relates to a new and innovative adjustable tarpaulin that enables the tarpaulin to be adjusted to various predetermined lengths, and more secured fastening of the tarpaulin. The present invention may be made of fabric, plastic-coated woven fabric, fleece or of unreinforced or reinforced edges and sides.

Tarpaulins are used as covers for protecting all types of materials against the influences of weather, cold, heat, dust and other harsh environment.

Tarpaulins are used, as fabricated, mainly for covering purposes. They are often made in a shaped form after being cut to a pattern. They may be provided with edge reinforcements, eyelets (or tie points) and other holding devices, for use as covers on trucks, cars, boats, protective covers on construction jobs, on railroads and for mail traffic, as well as for many other purposes. Tarpaulins which are provided with eyelets, supporting strips or other fastening means, have become very important in the construction industry where they serve to protect against weather, particularly during rainy, cold days, and dusty days.

There are two drawbacks to conventional tarpaulins. The first is that the conventional tarpaulins come in fixed sizes, so that a given tarpaulin might be ideal to be used for covering a certain item, but it would be either too large or too small to cover another item which is considerably larger or smaller. The second problem is that when the tarpaulins are used in heavily windy areas, the conventional tarpaulins with limited tied down areas, even with the best reinforced corners and edges, were often tearing because the conventional tarpaulins could not provide sufficient pull strength. Basically too much stress was put on each fastening point, because the tarpaulins were pulled only from one angle.

In connection with the first problem aforementioned, the user of conventional tarpaulins had to purchase several different sizes to accommodate different size items to be protected. In connection with the second problem, the tarpaulins were damaged easily, mainly due to a large rip starting from a small cut around reinforcements, due to too much stress around the reinforcements.

For the foregoing reasons, there is a need for a new and innovative adjustable tarpaulin that enables the tarpaulin to be adjusted between two or more prefixed sizes and a tarpaulin which can provide the distribution of the load from more than one angle so stress will be distributed over two different sets of tie down points.

SUMMARY

The present invention is directed to a new and innovative adjustable tarpaulin that enables the tarpaulin to be adjusted to various predetermined lengths, and more securely fastening of the tarpaulin. The present invention achieves the above advantages and benefits by having two or more valances on one or more of its side ends.

The first version of the present invention comprises of a tarpaulin having a top layer and a bottom layer. The top layer and the bottom layer are attached together to form a main body. The top layer and the bottom layer are loosely separated at one end wherein each of the top layer and the bottom layer extends out from the main body to form a valance of the top layer and a valance of the bottom layer.

On the opposite side of the main body, both the top layer and the bottom layer may extend out from the point where the top layer and the bottom layer of this side joined together to form a second valance of the top layer and a second valance of the bottom layer. Of course it is not necessary to have the second set of the valances, because even if this side does not have the combination of the valance of the top layer and the valance of the bottom layer, the tarpaulin itself may be already adjusted to two sizes as the first set of valances comprises of either the top layer or the bottom layer longer in length than the other. However, when we have the first set of valances on the first edge and we have the second set of valances on the second edge, then the tarpaulin may be adjusted to four different lengths, and the tarpaulin may be tied down from two different angles at each end.

When the tarpaulin is tied down at one end by two valances at two different angles, the pull force is distributed between two valances. Therefore, distributing the load under each end of the valance may reduced as much as half the load to each valance. As the load is distributed between two valances, the load on each of the tied point is significantly reduced. Because the load on each tied point is significantly reduced, the problem of the tarpaulin being ripped is also significantly reduced.

The length of each of the valances may vary according to the need of the manufacturer. It is possible to have the upper valance longer and the lower valance shorter on one end, and on the other end the upper valance may be shorter than the lower valance. There can be, as expected, any combination of varying lengths for valances for each tarpaulin. In any combination, because the joining of the valances are done through the entire side of the tarpaulin, the load is generally evenly distributed between two valances. Moreover, it is not necessary to use both valances at all times, but use one valance on one side and use one or more valances on the other side; especially to have the right length and the right size for the tarpaulin.

The second version of the invention is similar to the first version, but in the second version, the bottom layer does not extend to cover the full area of the main body but the bottom layer is much smaller in size than the top layer. Therefore, the bottom layer is only used for the formation of the lower valance on one side of the tarpaulin and not the other side. This means that the other side of the tarpaulin, at the option of the manufacturer, may or may not have the lower valance according to the manufacturers need. If the manufacturer requires the upper and the lower valance of the opposite side, then the opposite side may have a third layer which should be attached to the top layer to form the lower valance. Although the term of "third layer" is used to describe this lower sheet which forms the lower valance, the function, form and the size of this third layer may be identical to the bottom layer which has been used to form the first set of valances on the opposite side.

The third version of the present invention describes the tarpaulin with three valances on one side of the tarpaulin. The third valance on this one side is formed by having a tertiary layer attached to either the top layer or the bottom layer to form a tertiary valance. This tertiary valance may vary in any size and would provide the third valance to make the tarpaulin adjustable to three different lengths and to provide the third angle in which the load may be distributed evenly among the first valance, second valance and a third valance. All the benefits of the two valance version of this invention is incorporated into the third version, and it would be easy to see that load on each of the tied down points would be that much reduced for the three valance tarpaulin.

The inventor believes that the preferred version is the first version with the top layer and the bottom layer forming the main body wherein the sides and the shape of the top layer and the bottom layer are same so that the entire main body is formed as a double layer comprising of the top layer and the bottom layer. Moreover, an additional improvement may be made by having one or more corner protectors attached to each of the valance corners and one or more side protectors attached to wherever the tarpaulin is pulled by a tie down.

Additional versions of this invention could be provided by having additional layers to form additional valances on either side or both sides of the main body. As each additional valance is added onto each side of the tarpaulin, the functional size of the tarpaulin may be adjusted according to each of the lengths of the valances available. This means that one tarpaulin may be now used to cover and to store many different sizes of items, such as trucks, cars, boats and railroad cars. Moreover, in heavy wind areas, because the load on the tarpaulin may be distributed among all available valances, the wind resistance of the tarpaulin may be double or tripled compared to that of the conventional tarpaulins.

DRAWINGS

DESCRIPTION

With reference to the figures, several embodiments of the adjustable tarpaulin (11) according to the present invention are illustrated.

Figure 1:
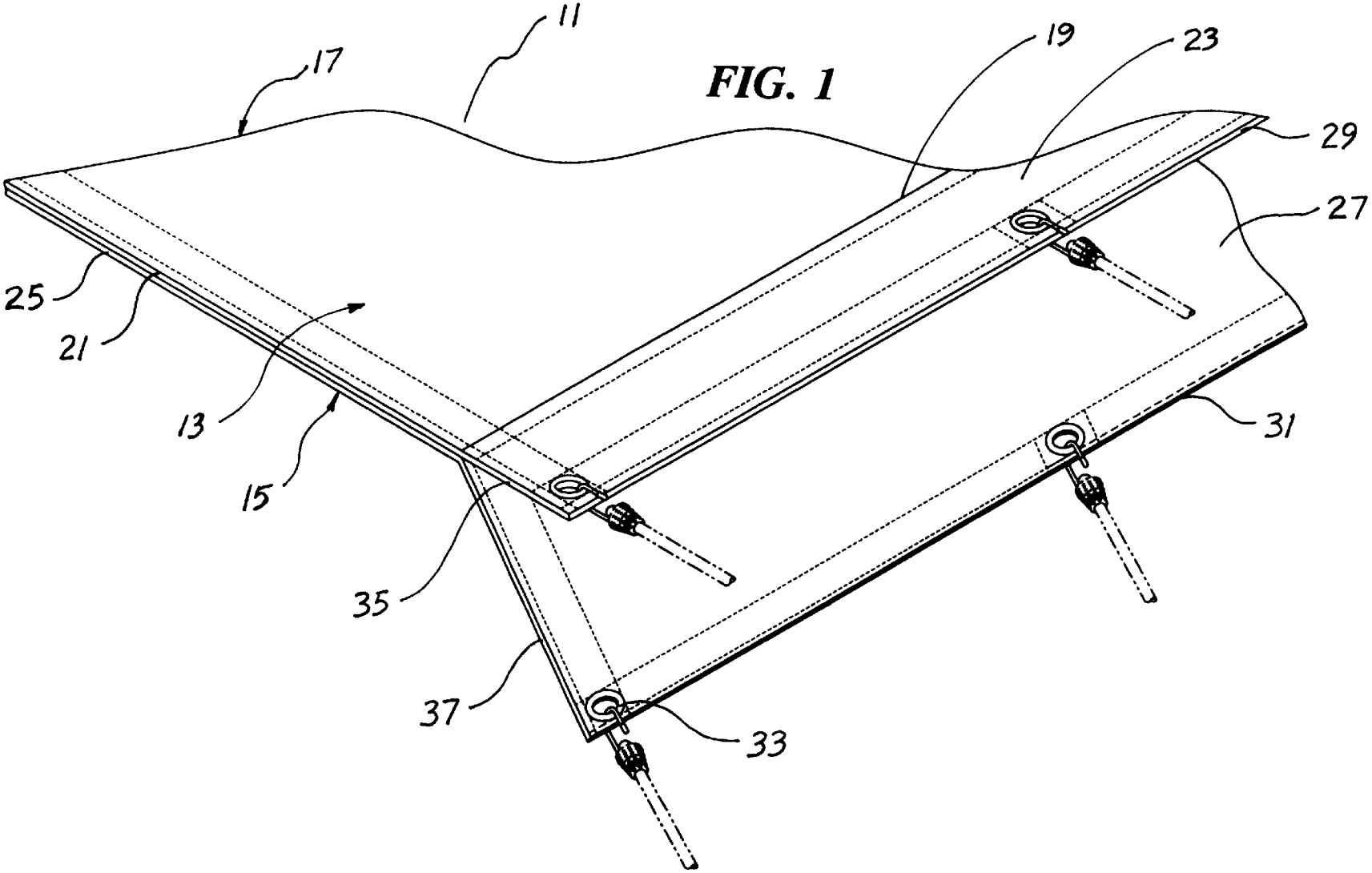
FIG. 1 is a partial isometric view of a tarpaulin with the first set of valances.

FIG. 1 is a partial isometric view of the adjustable tarpaulin (11) with a first set of valances. This first version of the adjustable tarpaulin (11) made according to the present invention comprises a top layer (13) having at least one side and a bottom layer (15) having at least one side attached together to form a main body (17) of the adjustable tarpaulin (11). The adjustable tarpaulin (11) further comprises a first valance edge of the main body (19) wherein at this first valance edge of the main body (19), the top layer (13) and the bottom layer (15) are joined together. From this first valance edge of the main body (19), one of the sides of the top layer (21) extends out to form a first valance of the top layer (23). Also, from the first valance edge of the main body (19), one of the sides of the bottom layer (25) extends out to form a first valance of the bottom layer (27). Because the first valance of the top layer (23) and the first valance of the bottom layer (27) are only joined together along the first valance edge of the main body (19), a top layer first valance outer edge (29) and a bottom layer first valance outer edge (31) may be freely and independently moved about the first valance edge of the main body (19).

When the top layer first valance outer edge (29) and the bottom layer first valance outer edge (31) are pulled independently at different angles, any load that is exerted on the main body is shared between the first valance of the top layer (23) and the first valance of the bottom layer (27). The result is the reduction of the force that is exerted on each of the tie points (33) on the first valance of the top layer (23) or the first valance of the bottom layer (27) making the adjustable tarpaulin (11) much stronger than any of the conventional tarpaulins.

Each of the first valance of the top layer (23) and the first valance of the bottom layer (27) may be independently sized and may have its independent length so that between the first valance of the top layer (23) and the first valance of the bottom layer (27), the adjustable tarpaulin (11) can be adjusted to two different lengths to accommodate two different items that need to be protected. This difference in length and size between the first valance of the top layer (23) and the first valance of the bottom layer (27) is illustrated in FIG. 1.

The adjustable tarpaulin (11) as shown on FIG. 1 also shows that the first valance of the top layer (23) has a top layer first valance outer edge (29) and at least one top layer first valance side edge (35). Similarly, the first valance of the bottom layer (27) has a bottom layer first valance outer edge (31) and at least one bottom layer first valance side edge (37). FIG. 1 shows that the bottom layer first valance outer edge (31) may be pulled farther away from the first valance edge of the main body (19) than the top layer first valance outer edge (29) because at least one of the top layer first valance side edges (35) is shorter than a corresponding bottom layer first valance side edge (37).

Although it is not shown on FIG. 1, a couple of different variations in the length of the top layer first valance side edge (35) and the bottom layer first valance side edge (37) can provide the following modifications. It is possible to have the top layer first valance outer edge (29) pulled further away from the first valance edge of the main body (19) than the bottom layer first valance outer edge (31) when at least one of the top layer first valance side edges (35) is longer than the corresponding bottom layer first valance side edges (37). Similarly, the top layer first valance outer edge (29) may be designed to be pulled away from the first valance edge of the main body (19) about as much as the bottom layer first valance outer edge (31) when each of the top layer first valance side edges (35) is about the same length as the corresponding bottom layer first valance side edges (37). Therefore, it is easy to understand that, by varying the length of either or both of the top layer first valance side edge (35) and the bottom layer first valance side edge (37), the overall length of the adjustable tarpaulin (11) may be adjusted accordingly.

Figure 2:
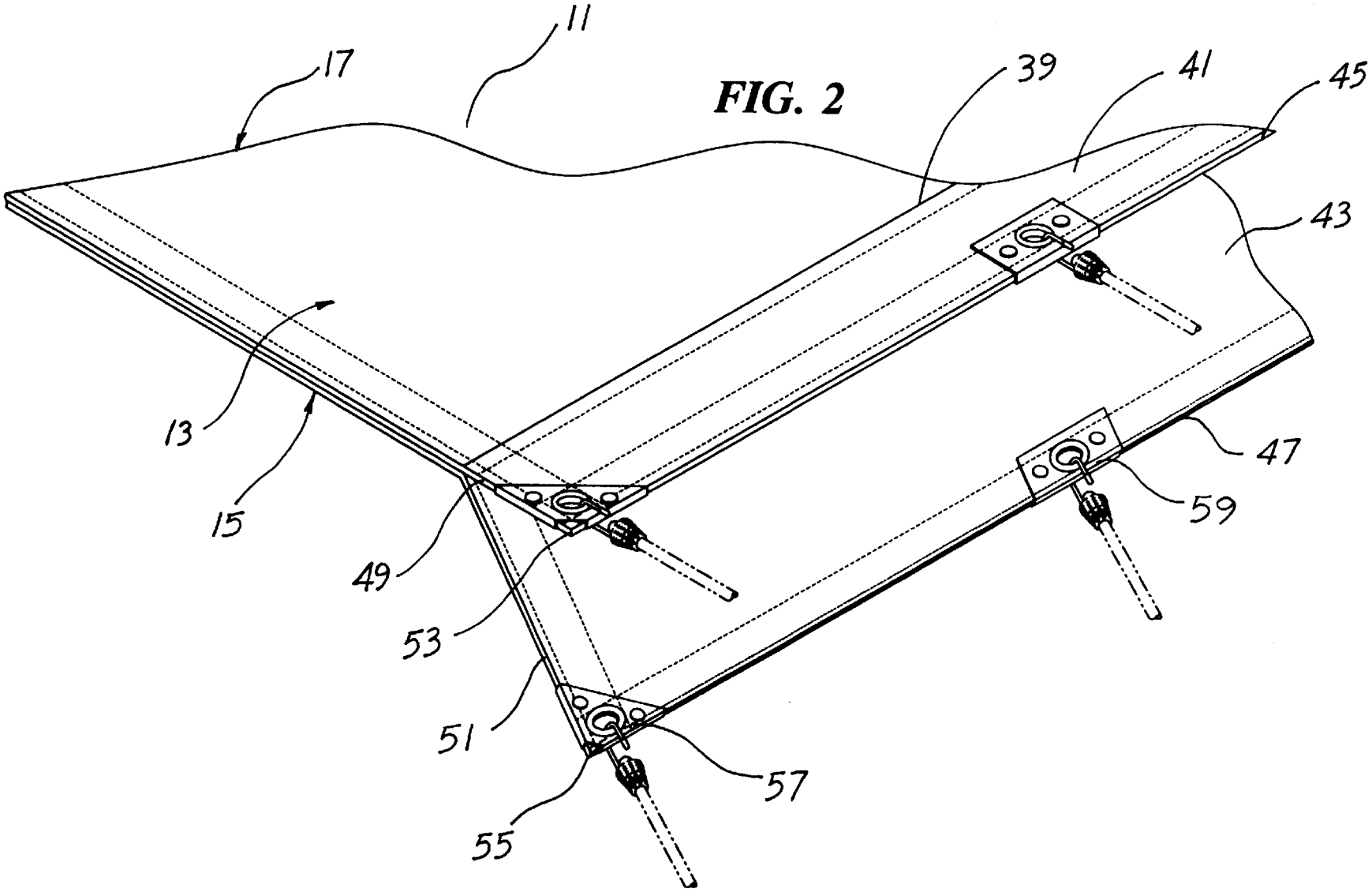
FIG. 2 is a partial isometric view of a tarpaulin with the second set of valances on the opposite side of the first set of valances as shown on FIG. 1.

FIG. 2 is a partial isometric view of the adjustable tarpaulin (11) with the second set of valances on the opposite side of the first set of valances as shown in FIG. 1. FIG. 2 is like a mirror image of FIG. 1. To illustrate, on the opposite side of the adjustable tarpaulin (11), a second set of valances could be formed identical to or similar to the first set of valances.

FIG. 2 illustrates that a second valance edge of the main body (39) is formed where the top layer (13) and the bottom layer (15) are joined together. The second valance edge of the main body (39) can be formed on the opposite side of the adjustable tarpaulin (11), away from the side of the first valance edge of the main body (19), or at any other side of the main body (17), including an adjacent side of the main body (17) of the side which has the first valance edge of the main body (19).

FIG. 2 further illustrates that a second valance of the top layer (41) is formed when one of the sides of the top layer, the side forming the second valance of the top layer (41) being different from the side of the top layer (13) which formed the first valance of the top layer (23), extending out from the second valance edge of the main body (39). Moreover, a second valance of the bottom layer (43) is formed when one of the sides of the bottom layer (15), the side forming the second valance of the bottom layer (43) being different from the side of the bottom layer (15) which formed the first valance of the bottom layer (27), extending out from the second valance edge of the main body (39).

Each of the top layer second valance outer edge (45) and the bottom layer second valance outer edge (47) may be pulled away from the second valance edge of the main body (39). The distance that each of the top layer second valance outer edge (45) and the bottom layer second valance outer edge (47) may travel can be varied by adjusting the length of a top layer second valance side edge (49) and a bottom layer second valance side edge (51).

When the adjustable tarpaulin (11) has a set of valances comprising the first valance of the top layer (23) and the first valance of the bottom layer (27), and a set of valances comprising the second valance of the top layer (41) and the second valance of the bottom layer (43), the adjustable tarpaulin (11) may be adjusted to four predetermined lengths. Moreover, there is no restriction as to which valance is to be the longest and which valance is to be the shortest. Therefore, any combination of the lengths among the first valance of the top layer (23), the first valance of the bottom layer (27), the second valance of the top layer (41) and the second valance of the bottom layer (43) may be used to form any combination of different valances according to the size requirements of the adjustable tarpaulin (11).

FIG. 2 shows a top layer second valance corner (53) formed by the top layer second valance side edge (49) and the top layer second valance outer edge (45) coming together. FIG. 2 also illustrates a bottom layer second valance corner (55) formed by the bottom layer second valance side edge (51) and the bottom layer second valance outer edge (47) coming together. Although it is not shown on FIG. 2, the illustration is a mirror image of FIG. 2, wherein a top layer first valance corner is formed by the top layer first valance side edge (35) and the top layer first valance outer edge (29) coming together. Similarly, a bottom layer first valance corner is formed by the bottom layer first valance side edge (37) and the bottom layer first valance outer edge (31) coming together.

These valance corners (53, 55) may be formed on each of the corners where anyone of, first valance side edges or second valance side edges come together with any one of, first valance or second valance outer edges. Thereupon, on one or more of each of the valance corners (53, 55), a corner protector (57) may be attached to strengthen each of the valance corners (53, 55). FIG. 2 also illustrates the use of one or more side protectors (59) to strengthen other tie points (33) located on the sides of the adjustable tarpaulin (11).

Figure 3:
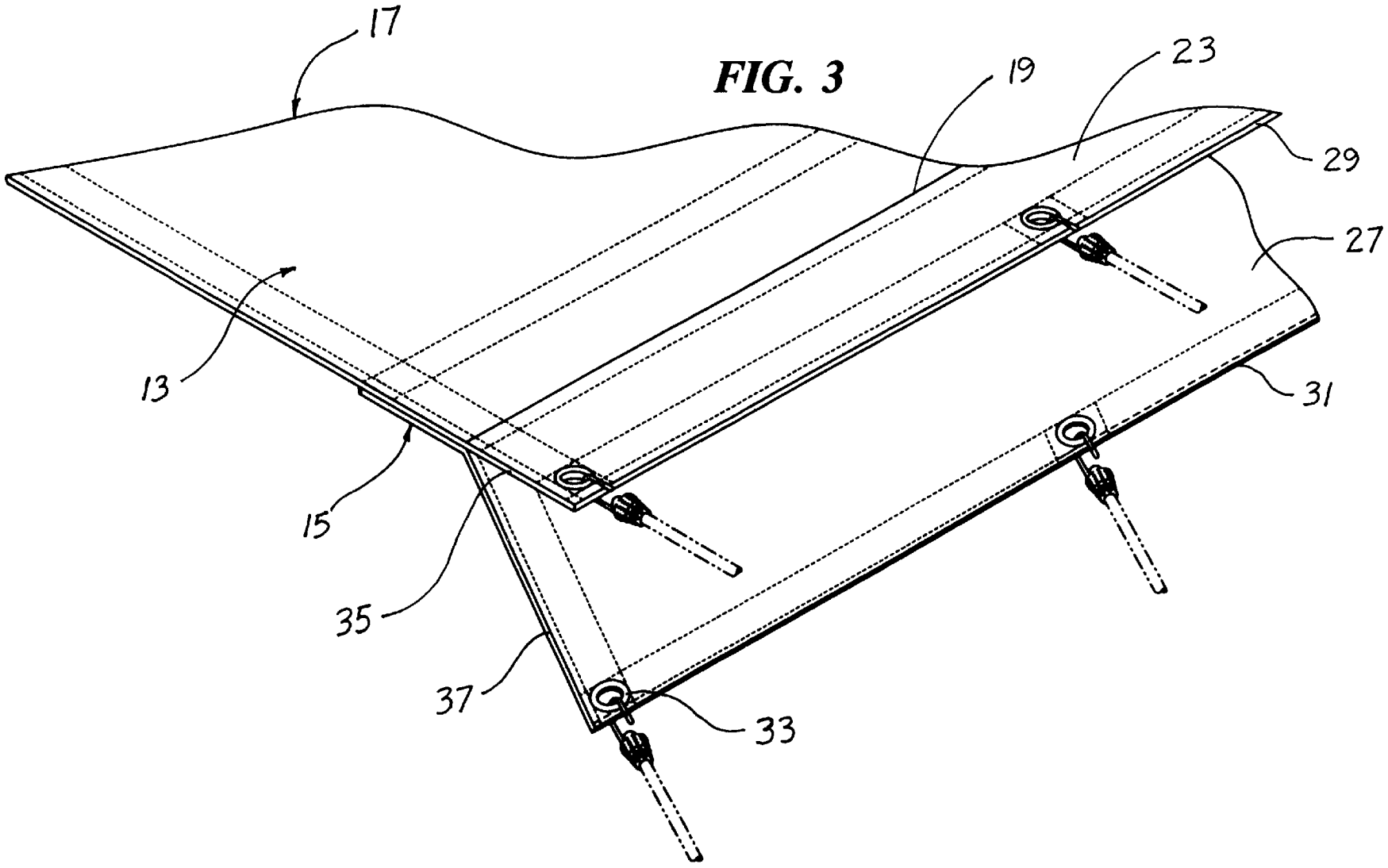
FIG. 3 is a partial isometric view of a tarpaulin with the first set of valances wherein the bottom layer is much smaller than the top layer.

FIG. 3 is a partial isometric view of the adjustable tarpaulin (11) with the first set of valances, as shown in FIG. 1, wherein the bottom layer (15) is much smaller than the top layer (13). An advantage of this version of the invention is that the main body (17) is mostly a single layer in its construction so the total weight of the adjustable tarpaulin (11) is reduced. Although this version of the adjustable tarpaulin (11) may be lighter, the inventor prefers the first version wherein the entire main body (17) is comprised of both the top layer (13) and the bottom layer (15). The first version, as shown in FIGS. 1 and 2, is easier to manufacture. Also, the adjustable tarpaulin (11) made according to the first version is much stronger against tear and against the environment.

Although it is not shown in FIG. 3, the adjustable tarpaulin (11) may further comprise a third layer wherein the third layer is attached to the opposite side of the first valance edge of the main body (19) so that the third layer provides the second set of the valances, similar to the illustration on FIG. 2. Therefore, although it is not shown in FIG. 3, the location where the top layer (13) and the third layer are joined together may be called a second valance edge of the main body (39) and a second valance of the top layer (41) formed by one of the sides of the top layer extending from the second valance edge of the main body (39), and a first valance of the third layer formed by one of the sides of the third layer extending out from the second valance edge of the main body (39).

Figure 4:
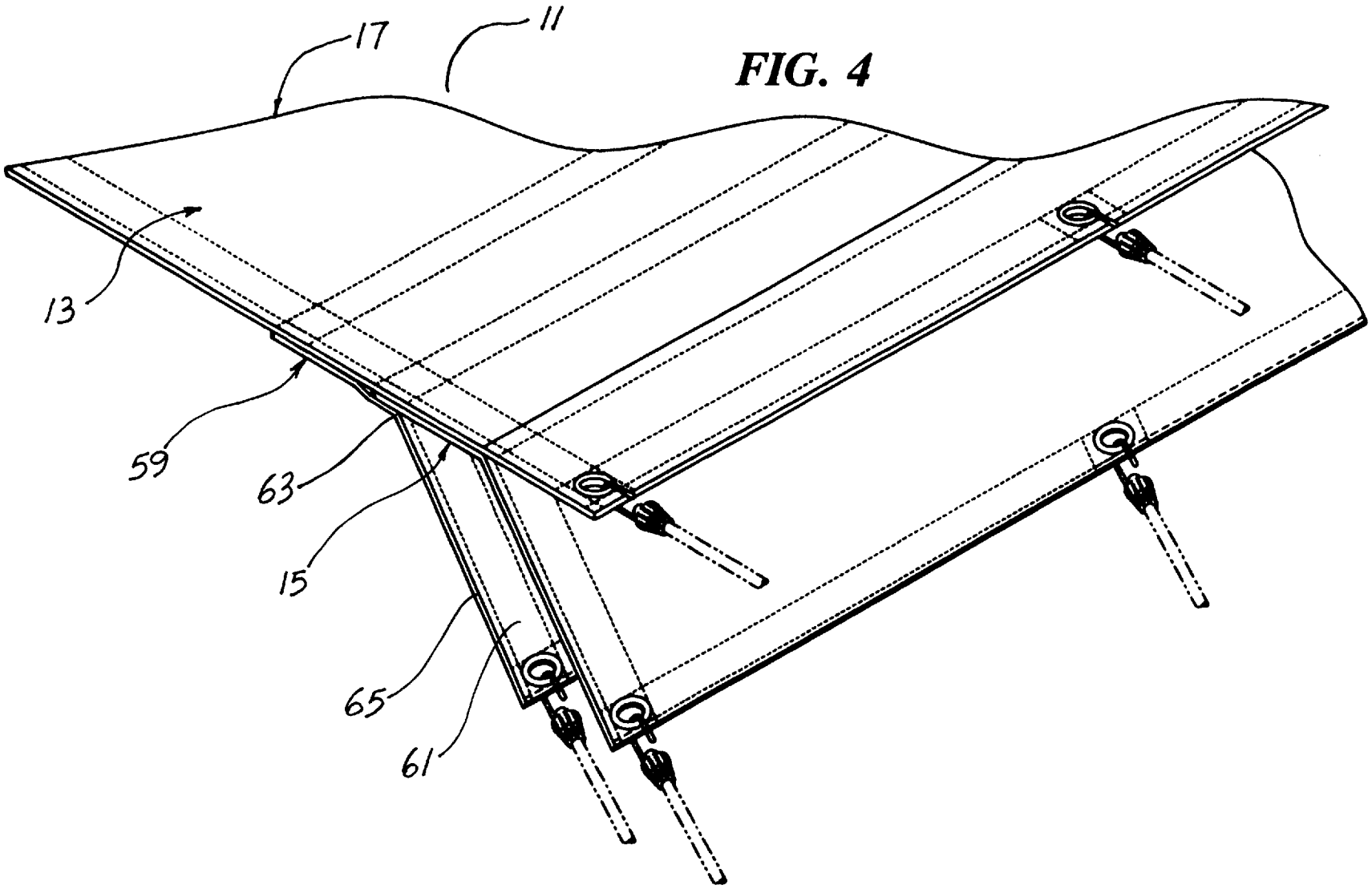
FIG. 4 is a partial isometric view of a tarpaulin with the first set of valances, and a tertiary layer forming a tertiary valance on the side of the first set of valances.
Figure 5:
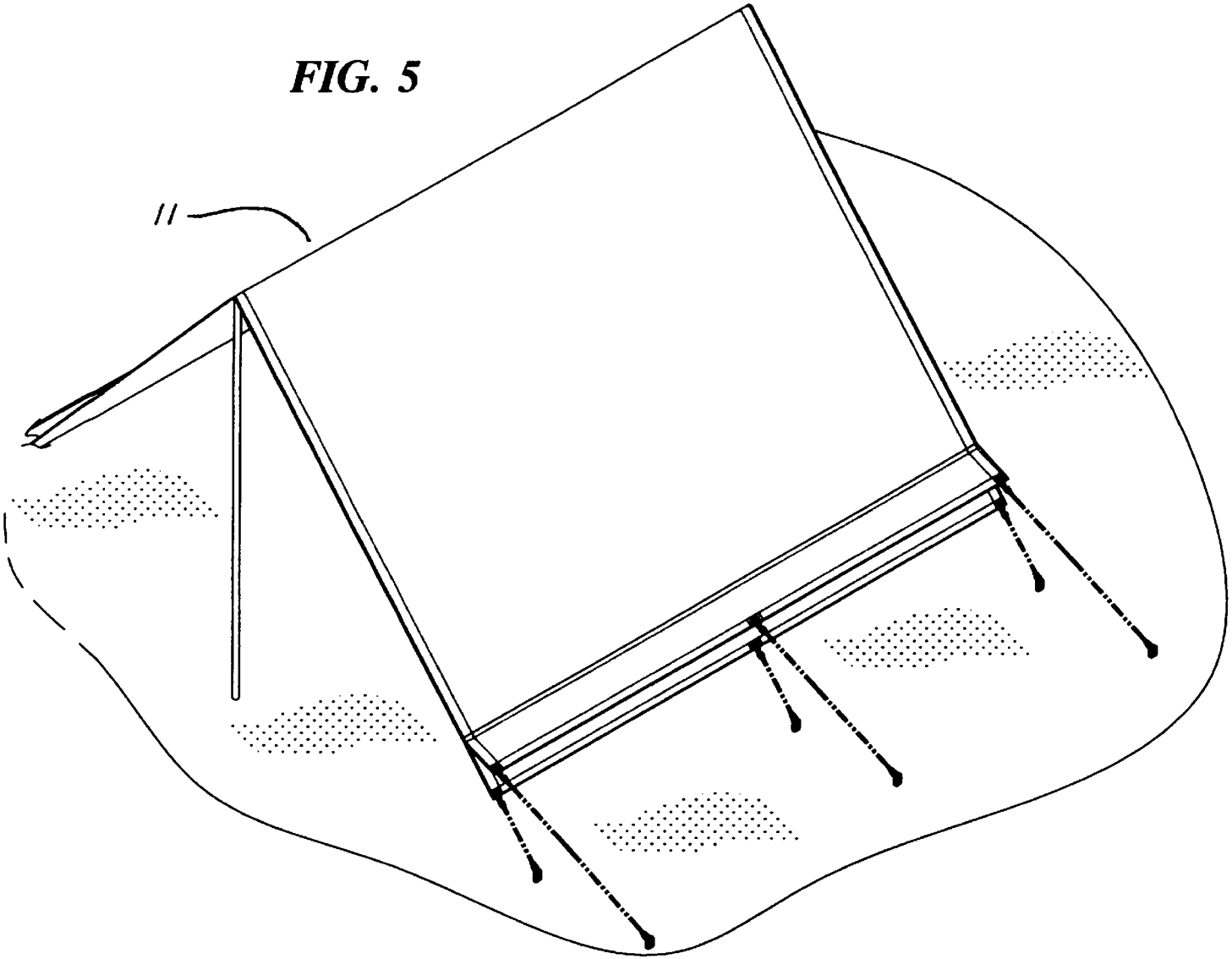
FIG. 5 is a isometric view of the present invention being used as intended.

FIG. 4 is a partial isometric view of the adjustable tarpaulin (11) with the first set of valances, and a tertiary layer (59) forming a tertiary valance (61) on the side of the first set of valances. The tertiary layer (59) has at least one side wherein the tertiary layer (59) is attached to the bottom layer (15) to form at least one tertiary valance edge (63), and a tertiary valance (61) formed by one of the sides of the tertiary layer (59) extending out from the tertiary valance edge (63). This tertiary layer (59) has a tertiary layer valance side edge (65) which may be adjusted as desired. Because the tertiary layer (59) forming the tertiary valance (61) provides the third valance on this side of the adjustable tarpaulin (11), the adjustable tarpaulin (11) may be adjusted to three different lengths because of the valances on this one side of the adjustable tarpaulin (11). Therefore, the load on the main body (17) of the adjustable tarpaulin (11) may be shared by three different sets of independent tied points pulled at three different angles.

Although the tertiary layer (59) is shown in FIG. 4 to be attached to the bottom layer (15) which is considerably less in size than the size of the top layer (13), the tertiary layer (59) may be attached to the adjustable tarpaulin (11), as shown in FIG. 1, the first version of the invention, wherein the top layer (13) and the bottom layer (15) are about same size to provide the main body (17) the double layer protection. Moreover, if the tertiary layer (59) is attached as shown in FIG. 4, wherein the size of the bottom layer (15) is much smaller that that of the top layer (13), then tertiary layer (59) may be attached wholly onto the top layer (13), on the side of the bottom layer (15). Therefore, the location of the tertiary layer (59) is not limited to the size or the shape of the bottom layer (15).

One advantage of this invention is its simplicity in enabling the tarpaulin (11) to be adjustable among predetermined lengths. This means that, one adjustable tarpaulin (11) can be used to cover and to store many different sizes of items, such as cars, boats, railroad cars, and trucks. Moreover, in heavy wind areas, because the load of the adjustable tarpaulin (11) may be distributed among all available valances, the wind resistance of the adjustable tarpaulin (11) may be doubled or tripled compared to that of the conventional tarpaulins. Furthermore, because the load to each tie point (33) is significantly reduced due to sharing of the loads and because the pull on the adjustable tarpaulin (11) is provided from more ideal angles, the tie points (33) are less susceptible to rips and tears, thus making the adjustable tarpaulin (11) longer lasting.

Although the present invention has been described in considerable detail with reference to certain preferred versions thereof, other versions are possible. For example, although the figures illustrate the adjustable tarpaulin (11) to have the sets of valances coming out from one side of the adjustable tarpaulin (11) and the opposite side, it is possible to have a set of valances coming out from each and everyone of the sides of the adjustable tarpaulin (11) to provide adjustable length between any two sides of the adjustable tarpaulin (11). Therefore, the spirit and the scope of the appended claims should not be limited to the description of the preferred versions contained herein.

What I claim is:

1. An adjustable tarpaulin comprising a) a top layer having at least one side;

b) a bottom layer having at least one side, wherein the bottom layer is attached to the top layer to form a main body, wherein at least a portion of the bottom layer is coextensive with the top layer along at least a portion of the main body, and wherein the bottom layer is smaller than about one third of the area of the top layer;

c) a first valance edge of the main body wherein the top layer and the bottom layer are joined together;

d) a first valance of the top layer formed by one of the sides of the top layer extending out from the first valance edge of the main body;

e) a first valance of the bottom layer formed by one of the sides of the bottom layer extending out from the first valance edge of the main body;

f) a third layer;

g) a second valance edge of the main body wherein the top layer and the third layer are joined together;

h) a second valance of the top layer formed by one of the sides of the top layer, the side forming the second valance of the top layer being different from the side of the top layer which formed the first valance of the top layer, extending out from the second valance edge of the main body; and i) a first valance of the third layer formed by one of the sides of the third layer, extending out from the second valance edge of the main body.

2. An adjustable tarpaulin comprising a) a top layer having at least one side;

b) a bottom layer having at least one side, wherein the bottom layer is attached to the top layer to form a main body, wherein at least a portion of the bottom layer is coextensive with the top layer along at least a portion of the main body, and wherein the bottom layer is considerably smaller in area than the top layer;

c) a first valance edge of the main body wherein the top layer and the bottom layer are joined together;

d) a first valance of the top layer formed by one of the sides of the top layer extending out from the first valance edge of the main body;

e) a first valance of the bottom layer formed by one of the sides of the bottom layer extending out from the first valance edge of the main body;

f) a tertiary layer having at least one side, wherein the tertiary layer is attached to the bottom layer to form at least one tertiary valance edge; and g) a tertiary valance formed by one of the sides of the tertiary layer extending out from the tertiary valance edge.

3. An adjustable tarpaulin comprising a) a top layer having at least one side;

b) a bottom layer having at least one side, wherein the bottom layer is attached to the top layer to form a main body, wherein at least a portion of the bottom layer is coextensive with the top layer along at least a portion of the main body, and wherein the bottom layer is considerably smaller in area than the top layer;

c) a first valance edge of the main body wherein the top layer and the bottom layer are joined together;

d) a first valance of the top layer formed by one of the sides of the top layer extending out from the first valance edge of the main body;

e) a first valance of the bottom layer formed by one of the sides of the bottom layer extending out from the first valance edge of the main body, f) a tertiary layer having at least one side, wherein the tertiary layer is attached to the top layer to form at least one tertiary valance edge; and g) a tertiary valance formed by one of the sides of the tertiary layer extending out from the tertiary valance edge.

* * * * *